US009942662B2

(12) United States Patent
Sears et al.

(10) Patent No.: US 9,942,662 B2
(45) Date of Patent: Apr. 10, 2018

(54) ELECTRO-ACOUSTIC DRIVER HAVING COMPLIANT DIAPHRAGM WITH STIFFENING ELEMENT

(71) Applicant: Bose Corporation, Framingham, MA (US)

(72) Inventors: Adam Sears, Shrewsbury, MA (US); Christopher A. Pare, Franklin, MA (US); Brock Jacobites, Hopkinton, MA (US); Andrew D. Munro, Arlington, MA (US); Thomas Landemaine, Allston, MA (US); Nicholas John Joseph, Boston, MA (US); Marek Kawka, Bolton, MA (US); Prateek Nath, Southborough, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/182,055

(22) Filed: Jun. 14, 2016

(65) Prior Publication Data

US 2017/0359655 A1 Dec. 14, 2017

(51) Int. Cl.

| | |
|---|---|
| ***H04R 9/06*** | (2006.01) |
| ***H04R 7/24*** | (2006.01) |
| ***H04R 7/04*** | (2006.01) |
| ***H04R 7/16*** | (2006.01) |
| ***H04R 9/02*** | (2006.01) |

(52) U.S. Cl.

CPC ..... *H04R 7/24* (2013.01); *H04R 7/04* (2013.01); *H04R 7/16* (2013.01); *H04R 9/025* (2013.01); *H04R 9/06* (2013.01)

(58) Field of Classification Search

CPC ... H04R 7/24; H04R 7/04; H04R 7/16; H04R 9/025; H04R 9/06

See application file for complete search history.

(56) References Cited

U.S. PATENT DOCUMENTS 4,699,242 A 10/1987 Ono
8,107,665 B2 1/2012 Haapapuro et al.
(Continued)

FOREIGN PATENT DOCUMENTS

DE 102005006741 A1 8/2006
EP 1940199 A1 7/2008
(Continued)

OTHER PUBLICATIONS

International Search Report & Written Opinion in International Patent Application No. PCT/US17/37238, dated Aug. 16, 2017; 18 pages.

*Primary Examiner* — Tuan D Nguyen
(74) *Attorney, Agent, or Firm* — Schmeiser, Olsen & Watts LLP

(57) ABSTRACT

An electro-acoustic driver includes a diaphragm formed of a compliant material, a bobbin configured to hold a winding of an electrical conductor and a housing having a housing axis that is substantially coaxial with the bobbin. The diaphragm is fixed to one end of the housing and has a substantially planar shape when the diaphragm is at rest. A stiffening element is fixed to an inner region of a surface of the diaphragm. A motion of the bobbin along a bobbin axis generates a movement of the inner region of the diaphragm to thereby generate an acoustic signal that propagates from the diaphragm.

12 Claims, 7 Drawing Sheets

(56) References Cited

U.S. PATENT DOCUMENTS

| | | | | |
|---|---|---|---|---|
| 2004/0188175 | A1 | 9/2004 | Sahyoun | |
| 2011/0103638 | A1* | 5/2011 | Lemarquand ..... | H04R 9/04<br>381/400 |
| 2011/0222721 | A1 | 9/2011 | Matsuda et al. | |
| 2016/0234618 | A1* | 8/2016 | Honda ..... | H04R 1/02 |

FOREIGN PATENT DOCUMENTS

| | | | |
|---|---|---|---|
| EP | 2950554 | A1 | 12/2015 |
| JP | H08265895 | A | 10/1996 |

* cited by examiner

ELECTRO-ACOUSTIC DRIVER HAVING COMPLIANT DIAPHRAGM WITH STIFFENING ELEMENT

BACKGROUND

This disclosure relates to an electro-acoustic device having a compliant diaphragm. More particularly, the disclosure relates to a miniature electro-acoustic driver having a rigid and substantially planar acoustic diaphragm and a compliant surround.

SUMMARY

In one aspect, an electro-acoustic driver includes a diaphragm, a bobbin, a housing and a stiffening element. The diaphragm is formed of a compliant material and has a perimeter, a front surface, a back surface, an inner region and an outer region between the perimeter and the inner region, and a substantially planar shape when the diaphragm is at rest. The bobbin has an inner surface, an outer surface and a bobbin axis. The bobbin is configured to hold a winding of an electrical conductor on the outer surface. The housing has an end and a housing axis that is substantially coaxial with the bobbin axis. The perimeter of the diaphragm is fixed to the end of the housing. The stiffening element is fixed to the front surface or the back surface at the inner region of the diaphragm. A motion of the bobbin along the bobbin axis generates a movement of the inner region of the diaphragm to thereby generate an acoustic signal that propagates from the front surface of the diaphragm.

Examples may include one or more of the following features:

The stiffening element may include a rigid object disposed inside the bobbin and secured to the front surface or the back surface of the diaphragm at the inner region. The rigid object may be a thin film disc. The thin film disc may include a polyimide film. A bonding agent may be disposed between a surface of the rigid object and the front surface or the back surface of the diaphragm.

The stiffening element may be a cured layer of an adhesive.

The bobbin may further include a substantially planar surface at an end of the bobbin such that the substantially planar surface is normal to the bobbin axis and is fixed to the back surface of the diaphragm at the inner region, wherein the stiffening element includes the substantially planar surface of the bobbin. The substantially planar surface may be fixed directly to the back surface of the diaphragm. Alternatively, a layer of adhesive fixes the substantially planar surface of the bobbin to the back surface of the diaphragm at the inner region.

The inner region of the diaphragm may have a diameter that is substantially equal to an outer diameter of the bobbin and the outer region may have an annular shape.

In accordance with another aspect, an electro-acoustic driver includes a housing, a bobbin, an acoustic diaphragm and a compliant suspension. The housing has a cylindrical shape, a housing axis and an outer diameter that is less than about 4.5 mm. The bobbin has a bobbin axis that is substantially coaxial with the housing axis. The bobbin is disposed inside the housing and is configured to move along the bobbin axis. The acoustic diaphragm is secured to the bobbin and the compliant suspension surrounds the acoustic diaphragm and is secured to the acoustic diaphragm and the housing.

Examples may include one or more of the following features:

The electro-acoustic driver may further include a magnet assembly disposed inside the bobbin.

The electro-acoustic driver may further include a coil assembly secured to the bobbin.

The acoustic diaphragm and the compliant suspension may be substantially planar when at rest.

The acoustic diaphragm and the compliant suspension may be formed from a membrane of a compliant material and the electro-acoustic driver may further include a stiffening element fixed to an inner region of the membrane. The inner region may be a circular region that is concentric with the compliant suspension. The stiffening element may be a cured layer of an adhesive or a rigid object. The bobbin may include a substantially planar surface fixed to the inner region of the membrane.

The outer diameter of the housing may be between about 3.0 mm and 4.5 mm, between about 3.3 mm and 4.2 mm, or between about 3.6 mm and 3.9 mm.

The magnet assembly may include at least one magnet piece and the magnet piece may have a diameter that is between about 1.5 mm and 4.5 mm, between about 2.0 mm and 4.0 mm, or between about 2.5 mm and 3.5 mm.

A ratio of a radiating area of the driver to a total cross sectional area of the driver may have a value of about 0.7, a value between about 0.57 and 0.7, a value between about 0.6 and 0.67 or a value between about 0.62 and 0.65.

In accordance with another aspect, a diaphragm for an electro-acoustic driver includes a compliant membrane and a stiffening element. The compliant membrane has a perimeter, a front surface, a back surface, an inner region, an outer region between the perimeter and the inner region, and a substantially planar shape when the diaphragm is at rest. The stiffening element is fixed to one of the front surface and the back surface of the compliant membrane at the inner region.

Examples may include one or more of the following features:

The stiffening element may include a rigid object.

The stiffening element may be a cured layer of an adhesive.

BRIEF DESCRIPTION OF THE DRAWINGS

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Modern in-ear headphones, or earbuds, typically include microspeakers. The microspeaker may include a coil wound on a bobbin that is attached to an acoustic diaphragm. Motion of the diaphragm due to an electrical signal provided to the coil results in generation of an acoustic signal that is responsive to the electrical signal. The microspeaker may include a housing, such as a sleeve or tube, which encloses the bobbin and coil, and a magnetic structure. As the size of the earbud decreases, it becomes increasingly difficult to fabricate the acoustic diaphragm and surrounding suspension at one end of the bobbin and housing.

Figure 1A:
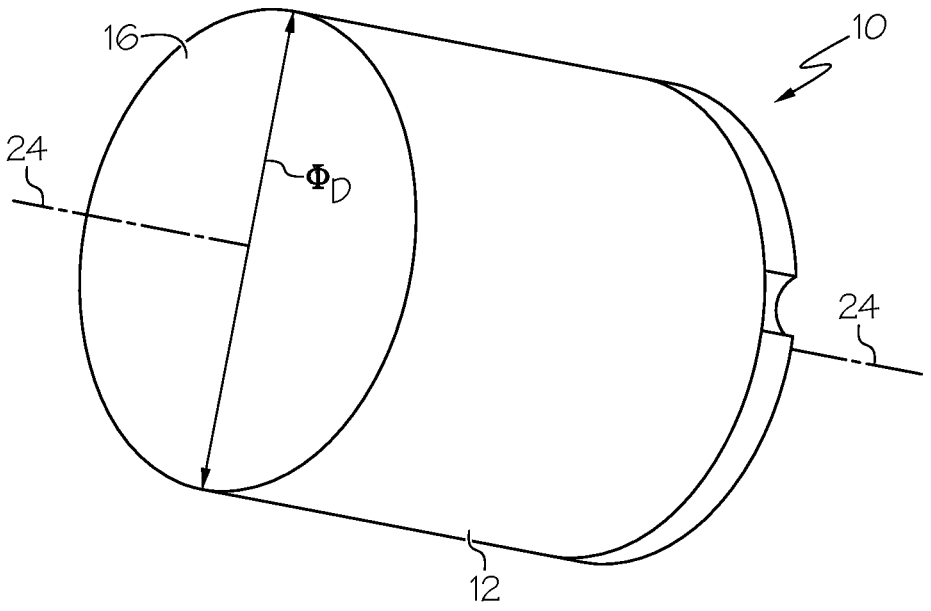
FIG. 1A, FIG. 1B and FIG. 1C are a perspective view, a cutaway view and an exploded cutaway view, respectively, of an electro-acoustic driver.
Figure 1B:
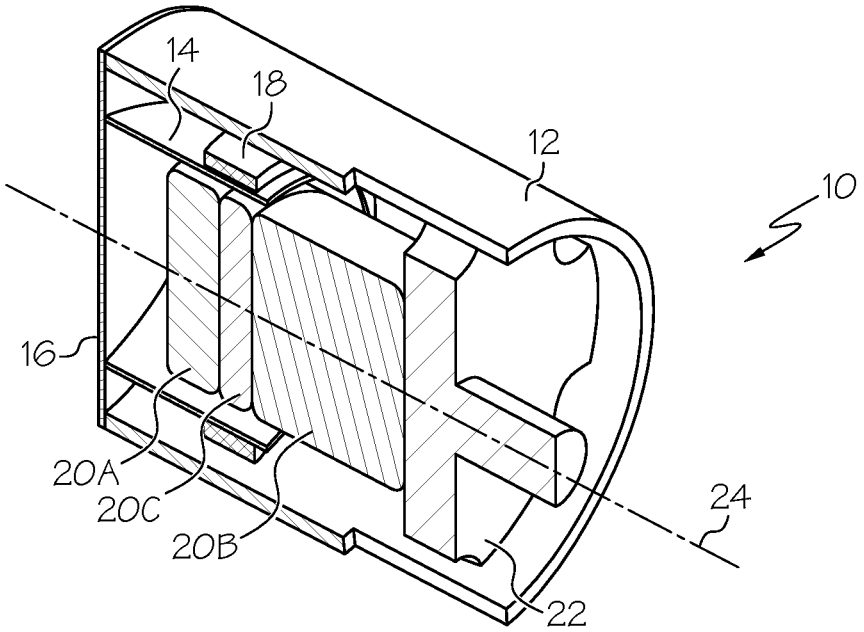
Figure 1C:
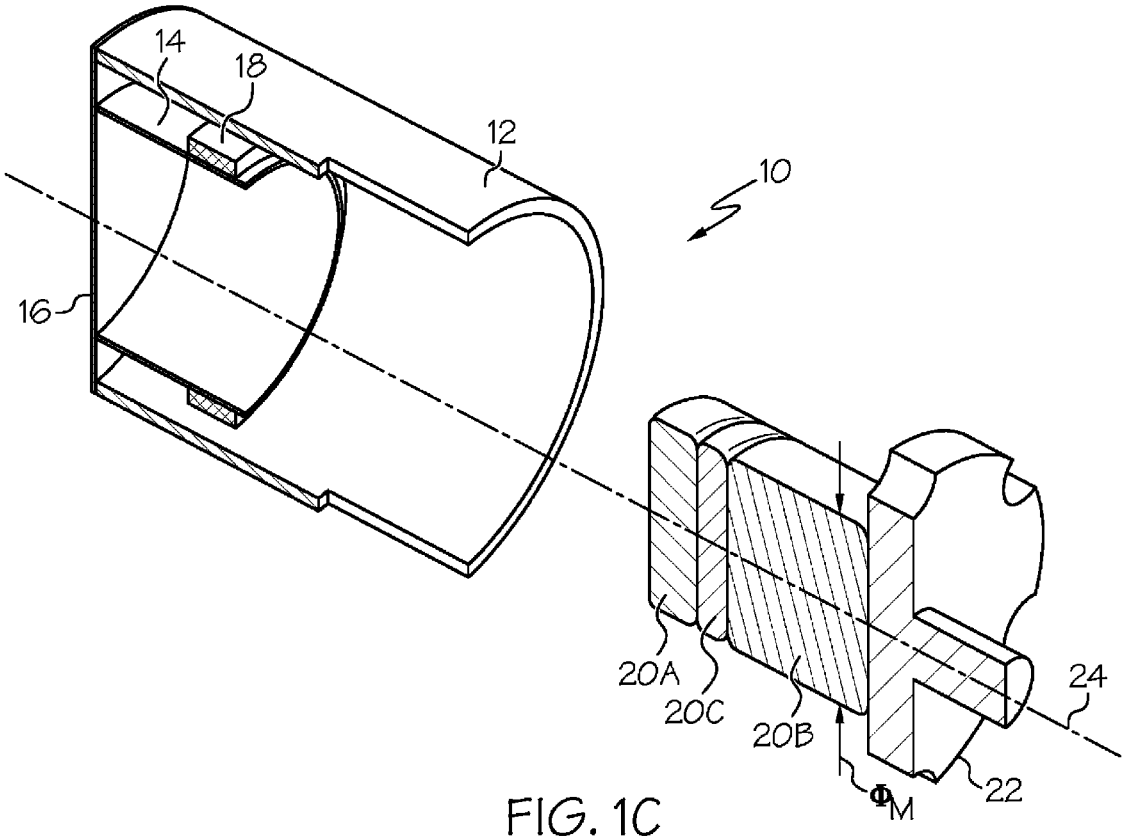

FIG. 1A, FIG. 1B and FIG. 1C are a perspective view, a cutaway perspective view and an exploded cutaway view, respectively, of an example of an electro-acoustic driver 10 (e.g., a microspeaker) that can be used in a miniature earbud. The microspeaker 10 includes a cylindrical housing 12 having an opening at both ends. Inside the housing 12 is a bobbin 14 that is nominally cylindrical in shape and open at both ends. In some examples, the housing 12 is made of stainless steel and the bobbin 14 is made of a polyimide (e.g., KAPTON®) or polyethylene terephthalate (PET) (e.g., MYLAR®). The housing 12 and bobbin 14 are secured at one of their open ends to a diaphragm, or membrane, 16 formed of a compliant material such as an elastomer. A coil assembly 18 is wound onto an outside surface of the bobbin 14. The coil assembly 18 includes a winding of an electrical conductor and may include a structure to hold the winding is a desired shape and/or to secure the winding on the outer surface of the bobbin 14. A magnet assembly 20 is secured to a platform 22 at an end of the housing 12 that is opposite to the diaphragm 16. The magnet assembly 20 includes two magnet pieces 20A and 20B that can be, for example neodymium magnets, and an intervening coin 20C. The magnet assembly 20 extends along a housing axis 24 (i.e., a cylinder axis) and into an open region inside the bobbin 14. The axis of the bobbin 14 is substantially co-axial with the housing axis 24.

The electro-acoustic driver 10 may be miniaturized such that the outer diameter $\phi_H$ of the housing and the diameter $\phi_D$ of the diaphragm 16 are less than about 4.7 mm. The small dimensions present various fabrication problems, including how to provide a small acoustic diaphragm supported by a compliant surround.

In some examples, the housing 12 has an outside diameter $\phi_H$ that is less than about 8 mm. In some examples, the housing 12 has an outside diameter $\phi_H$ that is less than about 4.5 mm. In other examples, the housing 12 has an outside diameter $\phi_H$ that is between about 3.0 mm and 4.5 mm. In other examples, the housing 12 has an outside diameter $\phi_H$ that is between about 3.3 mm and 4.2 mm. In other examples, the housing 12 has an outside diameter $\phi_H$ that is between about 3.6 mm and 3.9 mm. In some examples, the magnet pieces 20 have a diameter $\phi_M$ that is between about 1.5 mm and 4.5 mm. In other examples, the magnet pieces 20 have a diameter $\phi_M$ that is between about 2.0 mm and 4.0 mm. In other examples, the magnet pieces 20 have a diameter $\phi_M$ that is between about 2.5 mm and 3.5 mm. The radiating area is approximately equal to the area of an inner (central) region of the diaphragm 16 that is stiffened in any one of a variety of ways, including those described in detail below. In some examples, a ratio of the radiating area to the total cross sectional area of the driver 10 is about 0.7. In some examples, a ratio of the radiating area to the total cross sectional area of the driver 10 is between 0.57 and 0.7. In some examples, a ratio of the radiating area to the total cross sectional area of the driver 10 is between 0.6 and 0.67. In some examples, a ration of the radiating area to the total cross sectional area of the driver 10 is between 0.62 and 0.65.

Figure 2:
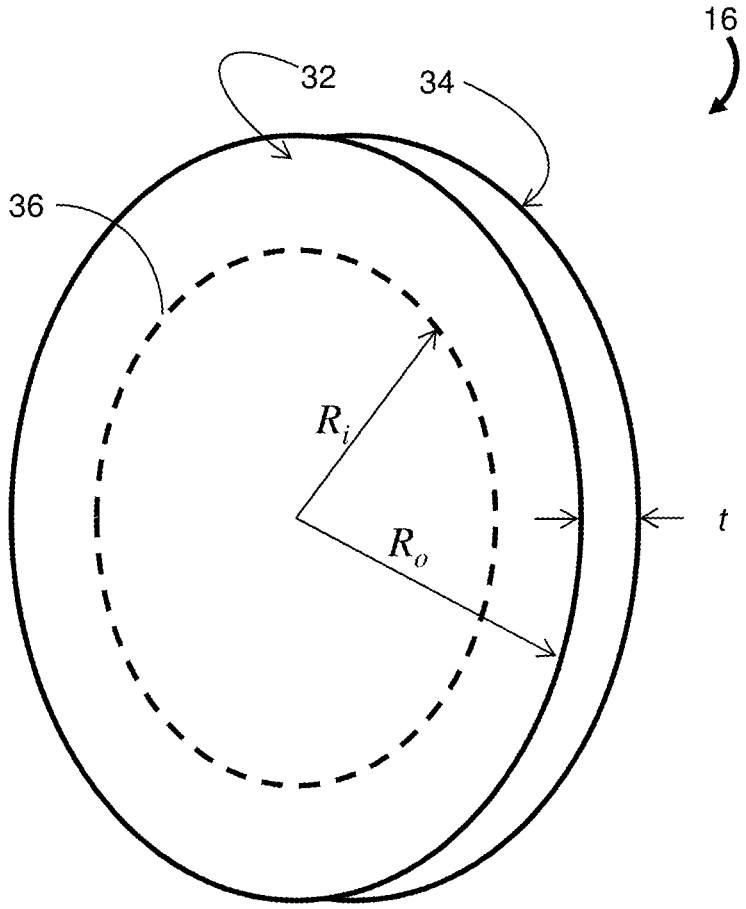
FIG. 2 is an illustration of the diaphragm of FIGS. 1A to 1C.

Referring also to FIG. 2, the diaphragm 16 is shown in isolation with its thickness t exaggerated to simplify identification of various features. The diaphragm 16 may be formed of an elastomeric material such as a volume of liquid silicone rubber that is cured to provide the desired thickness t and to adhere to an end of the bobbin 14 and an end of the housing 12. The diaphragm 16 has a perimeter, i.e., the circumferential outer edge at a radius Ro, a front surface 32 and a back surface 34. The diaphragm 16 includes an inner region inside the dashed circular line 36 of radius Ri and an outer region defined by an annular shape that extends from the dashed circular line 36 to the perimeter. The smaller radius Ri is approximately equal to the outer diameter of the cylindrical bobbin 14 and the larger radius Ro is approximately equal to the outer diameter of the housing 12. By way of non-limiting examples, the diaphragm thickness t can be a few tens of microns to more than 100 μm and the diameter Ro may be less than 4.7 mm.

The bobbin 14 moves substantially along its axis, and the housing axis 24, in response to an electrical current conducted through the winding of the coil assembly 18. This motion causes the inner region of the diaphragm 16 to move axially and displace air to thereby generate an acoustic signal.

The diaphragm 16 has a substantially planar shape when at rest, that is, when no electrical signal is applied to the winding of the coil assembly 18 to generate sound. When the microspeaker 10 is driven by an electrical signal to cause a motion of the bobbin 14 along the housing axis 24, the compliant nature of the diaphragm 16 results in its deformation. The inner region of the diaphragm 16 acts as an acoustic diaphragm that is used to generate the acoustic signal; however, due to the low value of Young's modulus for the diaphragm 16, the inner region can behave similar to a drum head. In particular, the inner region can exhibit unwanted structural resonances with the operating frequency band of the driver 10 and can result in a reduction in driver efficiency.

In various examples described below, the inner region of the diaphragm 16 is stiffened, or made rigid, by a stiffening element to substantially reduce or eliminate unwanted resonances during operation. The outer region of the diaphragm 16 is a compliant suspension that surrounds the stiffened inner region. In one example, the stiffening element is a rigid layer of material that is secured to the back surface 34 of the diaphragm 16 over the inner region and which is also secured to the adjacent portion of the inner surface of the bobbin 14. Alternatively, the stiffening element is a rigid object that is secured to the back surface 34 of the diaphragm 16 within the inner region. The object may be a standalone structure (e.g., a solid disc) or the object may be a structural feature of the bobbin. As a result of the stiffening of the inner region, unwanted resonance frequencies are shifted out of the operating bandwidth of the electro-acoustic driver 10 and/or the displacement of the diaphragm 16 at these resonance frequencies is substantially reduced. Consequently, a smoother acoustical frequency response can be achieved. In addition, stiffening of the inner region has an additional benefit of increasing the effective piston area of the electro-acoustic driver to thereby increase the sound pressure output for a particular bobbin displacement magnitude.

Figure 3:
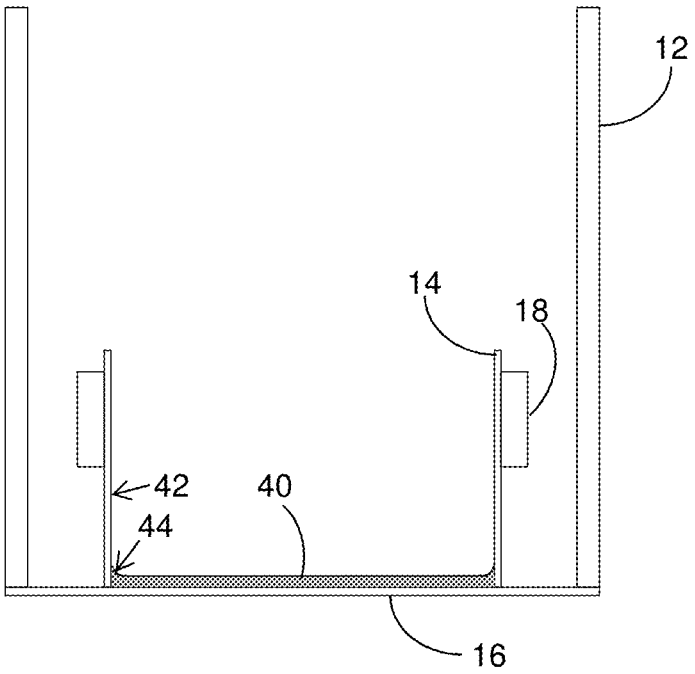
FIG. 3 is a cross-sectional side view of the housing, bobbin and coil assembly of FIGS. 1A to 1C according to an example in which an inner region of the diaphragm is stiffened by an adhesive.

FIG. 3 shows a cross-sectional side view of the housing 12, bobbin 14 and coil assembly 18 according to one example in which the inner region of the diaphragm 16 is stiffened. A small quantity of adhesive is dispensed into the "cup-shaped" structure defined by the bobbin 14 and diaphragm 16 to partially fill the cup. An adequate volume of adhesive is used to ensure that the inner region of the diaphragm 16 is fully covered by the adhesive layer. The adhesive is then cured to form a rigid layer 40 that adheres to a portion of the inner surface 42 of the bobbin 14 and the back surface 34 (see FIG. 2) of the diaphragm 16. A meniscus 44 may form along the inner wall and improve adhesion to the bobbin 14.

Figure 4:
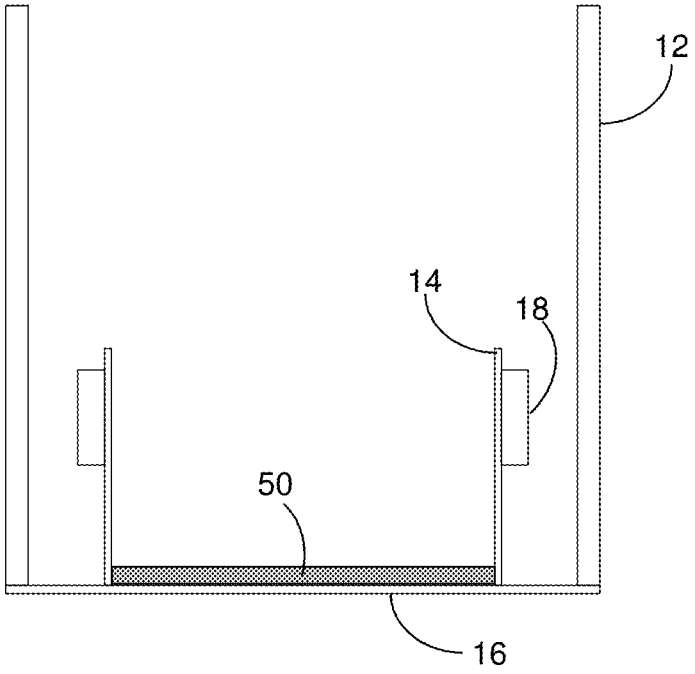
FIG. 4 is an alternative example in which a rigid object is used to stiffen the inner region of the diaphragm

FIG. 4 shows an alternative example in which a rigid object 50 (e.g., disc) is used to stiffen the inner region of the diaphragm 16. The disc 50 may be a high strength thermoplastic thin film such as a polyetherimide (e.g., ULTEM®). The disc 50 has a diameter that is less than the inner diameter of the bobbin 14 to enable the disc 50 to be inserted into the bobbin 14; however, the difference in the diameters is kept small to maximize contact with the inner region of the diaphragm 16. A thin layer of a bonding agent, or adhesive, may be used to bond the disc 50 to the inner region of the diaphragm 16. The bonding agent or adhesive may also be used to bond to the inner cylindrical surface of the bobbin 14. Alternatively, the disc 50 may be placed on top of an uncured layer of an elastomeric material (e.g., liquid silicone rubber) used to create the diaphragm 16. Subsequent curing of the elastomeric layer results in a bond of the diaphragm 16 directly to the disc 50 and the end of the bobbin 14.

Figure 5:
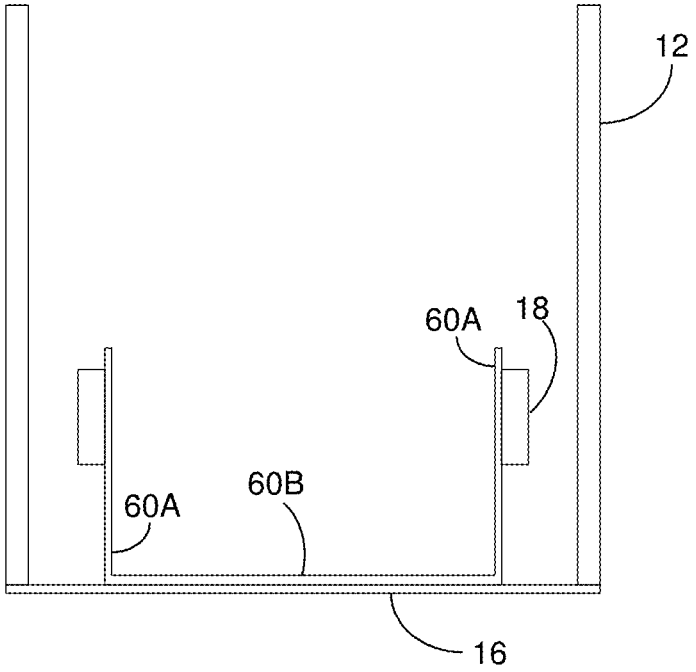
FIG. 5 is another alternative example in which a bobbin includes a planar surface to stiffen the inner region of the diaphragm.

FIG. 5 shows another alternative example in which a bobbin 60 contains structure that is used to stiffen the inner region. The bobbin 60 has a cylindrical portion 60A similar to the bobbin 14 of FIG. 3 and FIG. 4; however, the bobbin 60 also includes an end surface 60B at one end. The end surface 60B may be integrated with the cylindrical portion 60A as a single body. In an alternative configuration, the end surface 60B may be formed independently and then secured to the end of the cylindrical portion 60A. The end surface 60B may be fixed to the back surface 34 (see FIG. 2) of the diaphragm 16 along the inner region using a bonding agent or adhesive. Alternatively, the end surface 60B may be disposed within an uncured layer of an elastomeric material used to create the diaphragm 16 so that subsequent curing of the elastomeric material causes the diaphragm 16 to adhere to the surface 60B.

A number of implementations have been described. Nevertheless, it will be understood that the foregoing description is intended to illustrate, and not to limit, the scope of the inventive concepts which are defined by the scope of the claims. Other examples are within the scope of the following claims.

What is claimed is:

1. An electro-acoustic driver comprising: a diaphragm formed of a compliant material and having a perimeter, a front surface, a back surface, an inner region and an outer region between the perimeter and the inner region, and a substantially planar shape when the diaphragm is at rest; a bobbin having an inner surface, an outer surface and a bobbin axis, the bobbin configured to hold a winding of an electrical conductor on the outer surface, wherein the inner region of the diaphragm extends from a first inner surface region of the bobbin to a second inner surface region of the bobbin; a housing having an end and a housing axis that is substantially coaxial with the bobbin axis, the perimeter of the diaphragm being fixed to the end of the housing; and a stiffening element extending across at least the inner region from the first inner surface region of the bobbin at one end of the inner region to the second inner surface region of the bobbin at the other end of the inner region and fixed to one or more of the front surface and the back surface at the inner region of the diaphragm, wherein the outer region of the diaphragm includes a compliant suspension that surrounds the inner region stiffened by the stiffening element, and wherein a motion of the bobbin along the bobbin axis generates a movement of the inner region of the diaphragm to thereby generate an acoustic signal that propagates from the front surface of the diaphragm.

2. The electro-acoustic driver of claim 1 wherein the stiffening element comprises a rigid object disposed inside the bobbin and secured to the diaphragm at the inner region.

3. The electro-acoustic driver of claim 2 wherein the rigid object is a thin film disc.

4. The electro-acoustic driver of claim 3 wherein the thin film disc comprises a polyimide film.

5. The electro-acoustic driver of claim 2 further comprising a bonding agent disposed between a surface of the rigid object and the front surface or the back surface of the diaphragm.

6. The electro-acoustic driver of claim 1 wherein the stiffening element is a cured layer of an adhesive.

7. The electro-acoustic driver of claim 1 wherein the bobbin further comprises a substantially planar surface at an end of the bobbin, the substantially planar surface being normal to the bobbin axis and fixed to the back surface of the diaphragm at the inner region, and wherein the stiffening element comprises the substantially planar surface of the bobbin.

8. The electro-acoustic driver of claim 7 wherein the substantially planar surface is fixed directly to the back surface of the diaphragm.

9. The electro-acoustic driver of claim 7 further comprising a layer of adhesive to fix the substantially planar surface of the bobbin to the back surface of the diaphragm at the inner region.

10. The electro-acoustic driver of claim 1 wherein the bobbin has an outer diameter and the inner region of the diaphragm has a diameter that is equal to the outer diameter of the bobbin.

11. The electro-acoustic driver of claim 10 wherein the outer region has an annular shape.

12. The electro-acoustic driver of claim 1, wherein the outer region has a thickness that is less than the inner region.

* * * * *